US009653064B2

(12) United States Patent
Graber

(10) Patent No.: US 9,653,064 B2
(45) Date of Patent: May 16, 2017

(54) BLENDED WAVEGUIDE AND REFLECTOR

(76) Inventor: Curtis E. Graber, Woodburn, IN (US)

( * ) Notice: Subject to any disclaimer, the term of this patent is extended or adjusted under 35 U.S.C. 154(b) by 1368 days.

(21) Appl. No.: 12/460,686

(22) Filed: Jul. 23, 2009

(65) Prior Publication Data

US 2011/0019854 A1 Jan. 27, 2011

(51) Int. Cl.

| | |
|---|---|
| ***G10K 11/28*** | (2006.01) |
| ***H04R 1/28*** | (2006.01) |
| ***H04R 1/30*** | (2006.01) |

(52) U.S. Cl.

CPC ..... *G10K 11/28* (2013.01); *H04R 1/2888* (2013.01); *H04R 1/30* (2013.01)

(58) Field of Classification Search

CPC ..... G10K 11/18; G10K 11/20; G10K 11/22; G10K 11/28; G10K 11/26; G10K 11/32; H04R 1/2884; H04R 1/2888; H04R 1/30; H04R 1/32

USPC ..... 381/340, 341

See application file for complete search history.

(56) References Cited

U.S. PATENT DOCUMENTS

| | | | | |
|---|---|---|---|---|
| 2,815,087 | A * | 12/1957 | Delort | 181/152 |
| 3,666,041 | A * | 5/1972 | Engelhardt | 181/145 |
| 4,138,594 | A * | 2/1979 | Klipsch | 381/335 |
| 4,215,761 | A * | 8/1980 | Andrews | 181/152 |
| 4,313,032 | A | 1/1982 | Thomas | |
| 4,997,056 | A * | 3/1991 | Riley | G10K 11/28 181/129 |
| 5,099,948 | A * | 3/1992 | Melhart | 181/152 |
| 5,737,435 | A * | 4/1998 | De Poortere | H04R 1/30 181/151 |
| 5,832,079 | A * | 11/1998 | Rabe | H04M 1/0216 379/433.03 |
| 6,411,718 | B1 | 6/2002 | Danley | |
| 7,010,138 | B1 * | 3/2006 | Harris et al. | 381/337 |
| 7,268,467 | B2 * | 9/2007 | De Vries | H04R 1/345 181/150 |
| 7,275,621 | B1 * | 10/2007 | Delgado, Jr. | G10K 11/025 181/150 |
| 2004/0245043 | A1 * | 12/2004 | Noselli et al. | 181/176 |

* cited by examiner

*Primary Examiner* — Davetta W Goins
*Assistant Examiner* — Jasmine Pritchard
(74) *Attorney, Agent, or Firm* — Taylor IP, P.C.

(57) ABSTRACT

A blended acoustic folded horn and reflector provides for throughput of higher frequency bands without giving rise to standing waves. The horn includes a parabolic region intersected by a first direct radiant axis centered on the throat. The parabolic region is shaped and oriented to define a reflected radiant axis through the mouth for frequency components of the acoustic input above a cut-off frequency. The parabolic region operates to focus sound in the upper portion of the operational frequency range of the loudspeaker and to reflect the resulting focused sound beam along a second radiant axis through the mouth of the folded horn.

4 Claims, 8 Drawing Sheets

Polar Response of system in Human voice bandwidth of 250-1000hz @250 Hz.

Polar Response of system in Human voice bandwidth of 250-1000hz @355 Hz.

Polar Response of system in Human voice bandwidth of 250-1000hz@500 Hz.

Polar Response of system in Human voice bandwidth of 250-1000hz@708 Hz.

Polar response of alert tone bandwidth of 800-3000hz@1000 Hz.

Polar response of alert tone bandwidth of 800-3000hz @1412 and 2000 Hz.

BLENDED WAVEGUIDE AND REFLECTOR

BACKGROUND

1. Technical Field

The technical field relates to directional acoustic systems and more particularly to a blended folded waveguide/horn and acoustic reflector.

2. Description of the Technical Field

The reproduction of sound with high fidelity and at high intensity levels across a broad frequency range, poses a number of challenges. To do so from a small, energy-efficient package, portable enough to be moved and suitable for open air use is especially difficult. The issues are compounded where it is desirable to build a device based on a single transducer which can cover most of the audible frequency spectrum. Generally, high output, high efficiency loudspeaker systems have been built around horns. Low frequency units use propagation paths of relatively long lengths. In order to reduce external package size low frequency horns have had folded axes. The greater the degree of folding the more compact a horn can be made at the cost of restricting throughput of higher acoustic frequencies.

Klipsch, in U.S. Pat. No. 4,138,594, taught a small dimension low frequency loudspeaker incorporating a folded or "reflexed" horn which could operate in conjunction with mid and high range loudspeakers. The mid to high range loudspeakers were horn loaded using straight axis horns to produce a broad spectrum system. The Klipsch low frequency subsystem reflected research that found that a low frequency horn could be built using approximations of an exponential flare rather than a true curved interior surface. This allowed Klipsch to introduce flat surfaces to the low frequency horn, simplifying construction, and with minimal distortion for sounds at frequencies below 300 Hz.

Loudspeakers loaded with folded axis horns have not been favored for sound frequencies above about 300 Hz, particularly in the mid and upper ranges of human hearing. Klipsch found that folding produced severe variations in amplitude response of the horn. Folding a horn introduces an upper cut off frequency for sound transmission through the horn due to the fold giving rise to a standing wave in the horn above that frequency preventing emission of higher frequency sound from the horn. The cut off frequency, and the sharpness of sound transmission fall off, is a function of the degree of the angle subtended by the fold, how tight the angle is, and the cross sectional area of the horn in the vicinity of the fold. The flat faces in the Klipsch folded low frequency horn produce sharp turns in the horn which, while insignificant at low frequencies, but which came into play at higher frequencies. As a consequence Klipsch provided that the mid and upper frequency range loudspeakers were loaded with straight axis horns and the folded horn was restricted to use with a low frequency transducer.

Straight "multiple entry" horns are known which combine transducers in different band passes in a single horn.

SUMMARY

The blended folded horn and reflector includes an acoustic source operating over a frequency range located in the throat of the blended horn. The horn surface includes a parabolic region intersected by a first direct radiant axis centered in the throat. The parabolic region is shaped and oriented to define a second direct radiant axis through the mouth. The parabolic region operates to focus sound in the upper portion of the operational frequency range of the loudspeaker and to reflect the resulting focused sound beam along a second radiant axis through the mouth of the folded horn. In the lower portion of the operational frequency range of the loudspeaker the blended folded horn and reflector operates as a horn.

BRIEF DESCRIPTION OF THE DRAWINGS

Reference to the following detailed description of an illustrative embodiment will be aided when read in conjunction with the accompanying drawings, wherein.

DETAILED DESCRIPTION

Figure 1:
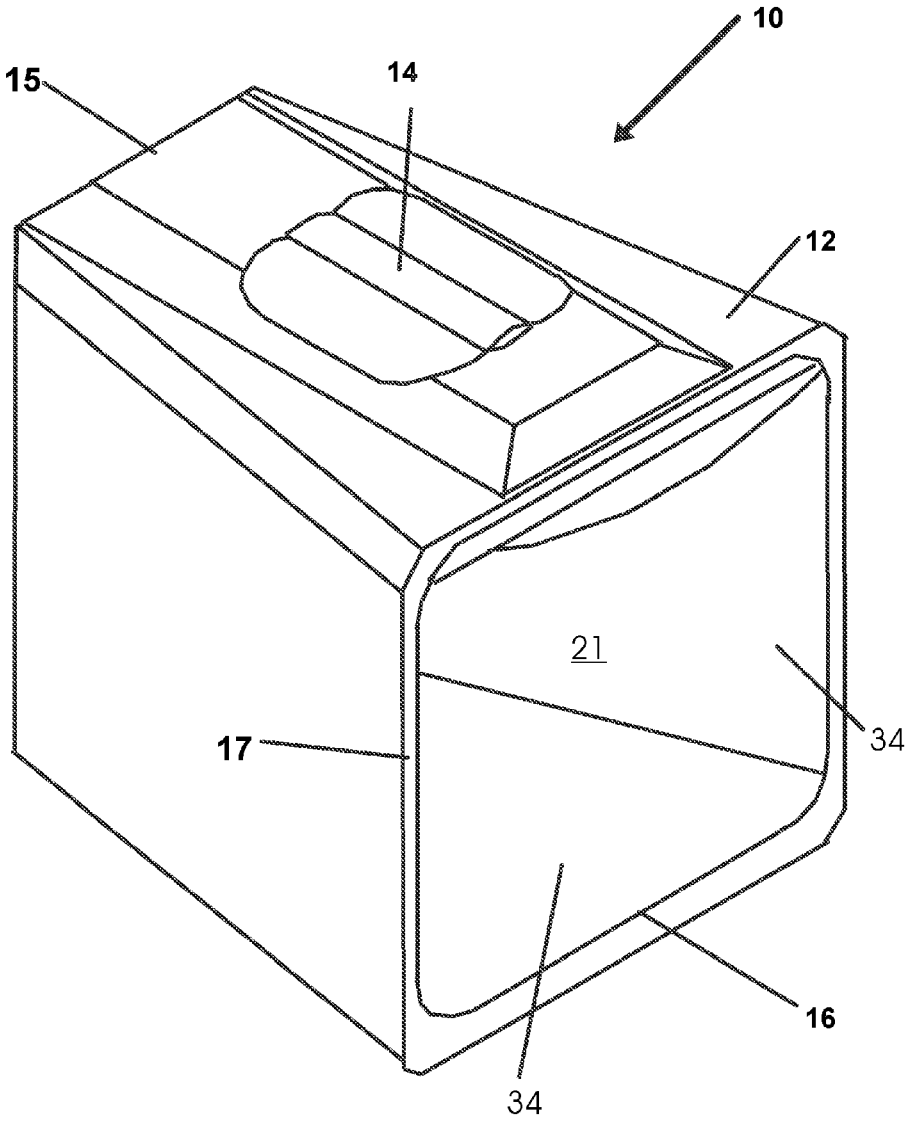
FIG. 1 is a perspective view of a loudspeaker system.

Referring to the FIGS. 1-5, a loudspeaker system 10 is illustrated incorporating a folded horn 18 in an enclosure 12. Enclosure 12 may be provided with a handle 14 positioned on an upper surface 15 for ease of handling. Sound is radiated from a mouth 16 in the front face 17 of the enclosure 12.

Enclosure 12 contains an acoustic transducer 20 and a folded horn 18. Enclosure 12 defines a sealed chamber 22 in which acoustic transducer 20 is mounted. The transducer 20 radiates into the throat 24 and the folded horn 18. Acoustic transducer 20 may be used to radiate sound from the bass into higher frequency ranges associated with human hearing, for example from 70 to 6000 Hz. At lower frequencies, for example below 300 Hz., folded horn 18 functions as a conventional horn. At these low frequencies minor variations in the shape of the interior surface of the horn have little effect on the propagation of sound through the horn or the horn's functioning as an acoustic transformer. In a conventional folded horn the folds can give rise to standing waves and prevent emission of higher frequency radiation from a horn mouth.

The minimum area of throat 24 may be smaller in area than the active surface area of the acoustic transducer 20. To the extent that the transducer 20 is operating in a compression chamber it may not be aligned with the reflector described below.

To overcome the standing wave issue in a folded horn, folded horn 18 incorporates a parabolic reflector in the horn channel to focus higher frequency acoustic radiation into a beam and to guide the acoustic radiation through the horn 18 and out of the mouth 16. Where one parabolic reflector is provided the reflector is positioned suspended or "floating" in the channel 21 of horn 18 so that it is on a line of sight with the mouth 16 and with the acoustic transducer 20. Should the fold subtend a greater angle than can be met using one reflector it is possible that more than one could be used, with modification of the parabola to reflect that focus into a beam of the desired dispersion can be distributed. While the reflector could be suspended in the horn 18, with provision made for locally adjusting the horn flare to maintain a constant effective flare rate accommodating the loss of cross sectional area due to the reflector structure. More typically though, a parabolic or paraboloidal reflector in folded horn 18 is met by providing a parabolic reflector section 32 which is flush with the wall 34 of the horn 18 and positioned in the wall across the incident projection axis 28 from acoustic transducer 20. The parabolic reflector section 32 is canted with respect to projection axis 28 so that center line of reflection of the higher frequency beam (the high frequency emission axis 30) of the loudspeaker system passes through roughly the center of the horn and thus is on a "line of sight" with both the mouth 16 and the throat 24 of the horn.

Figure 2:
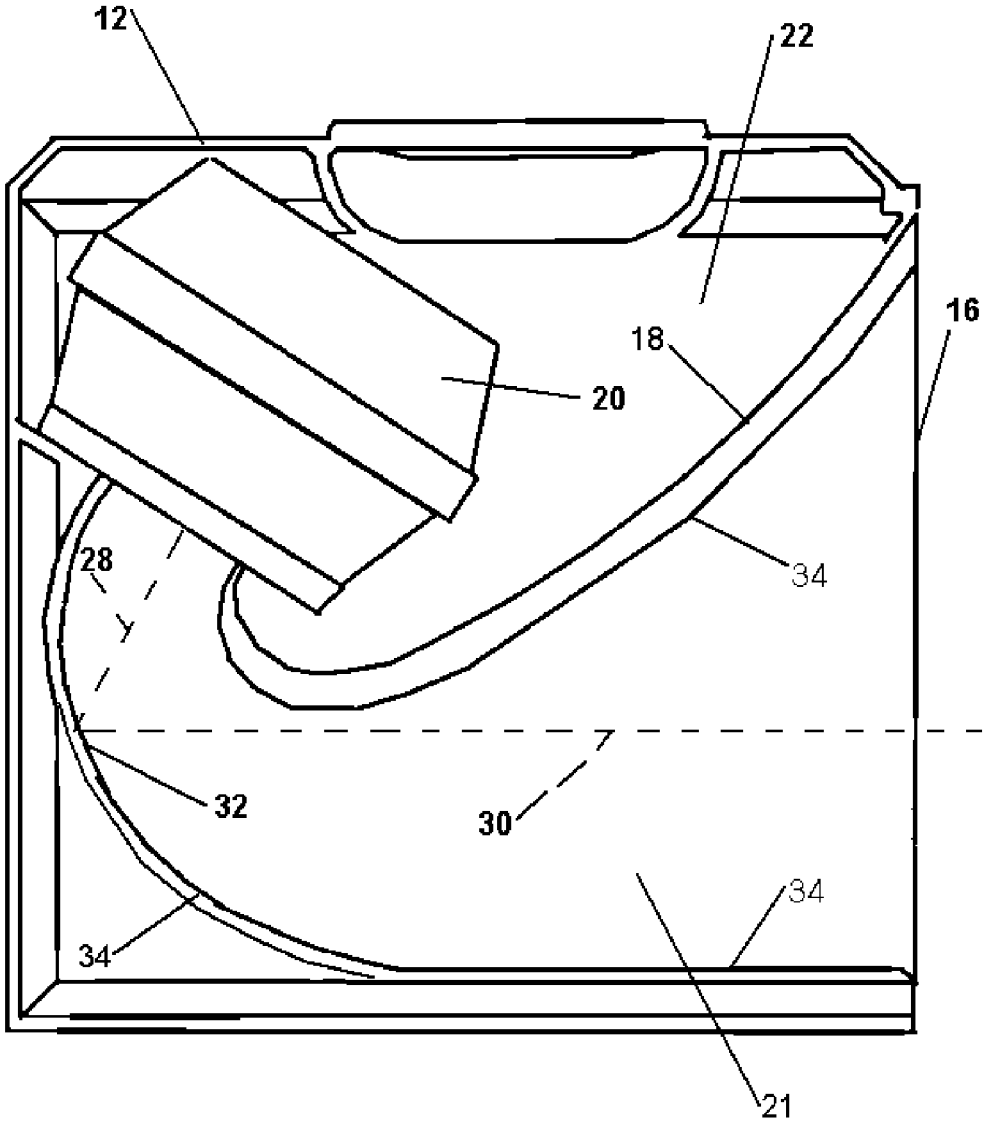
FIG. 2 is a cross sectional view of the loudspeaker system of FIG. 1 taken in a plane including the principal axis of a loudspeaker system horn.
Figure 3:
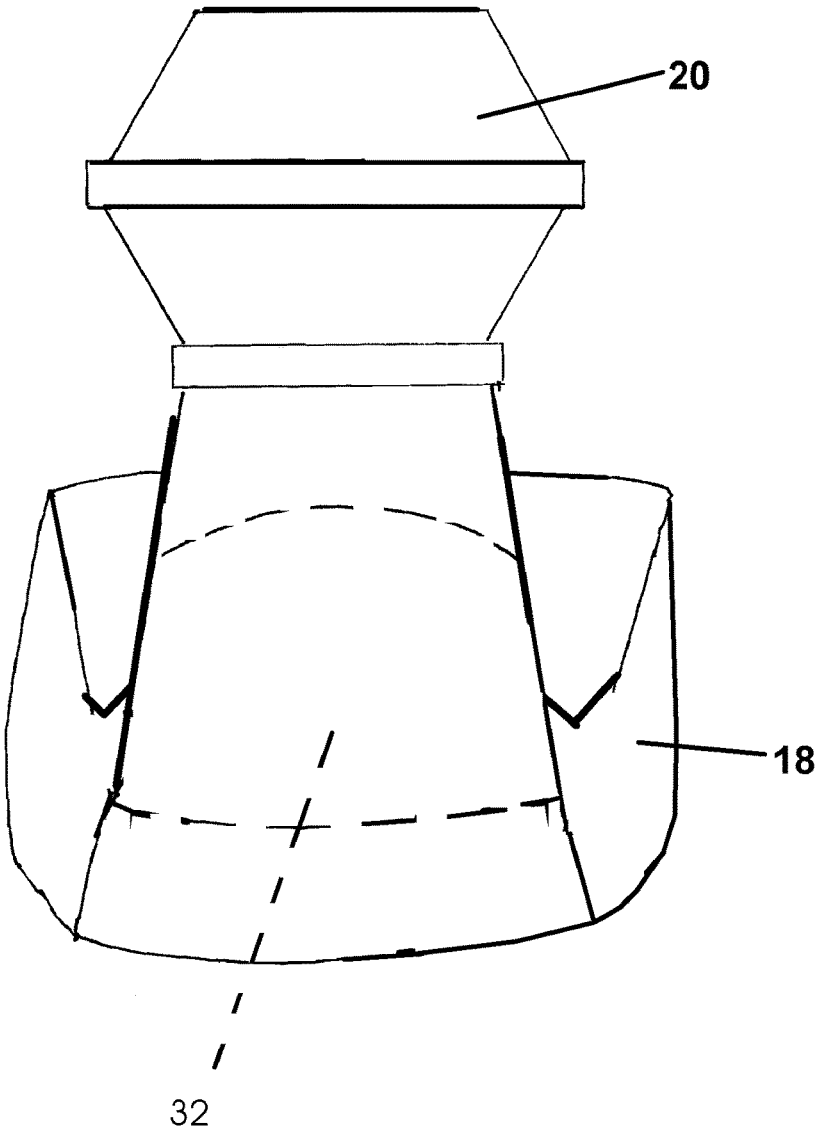
FIG. 3 is a rear elevation of the loudspeaker system horn clear of its enclosure.
Figure 4:
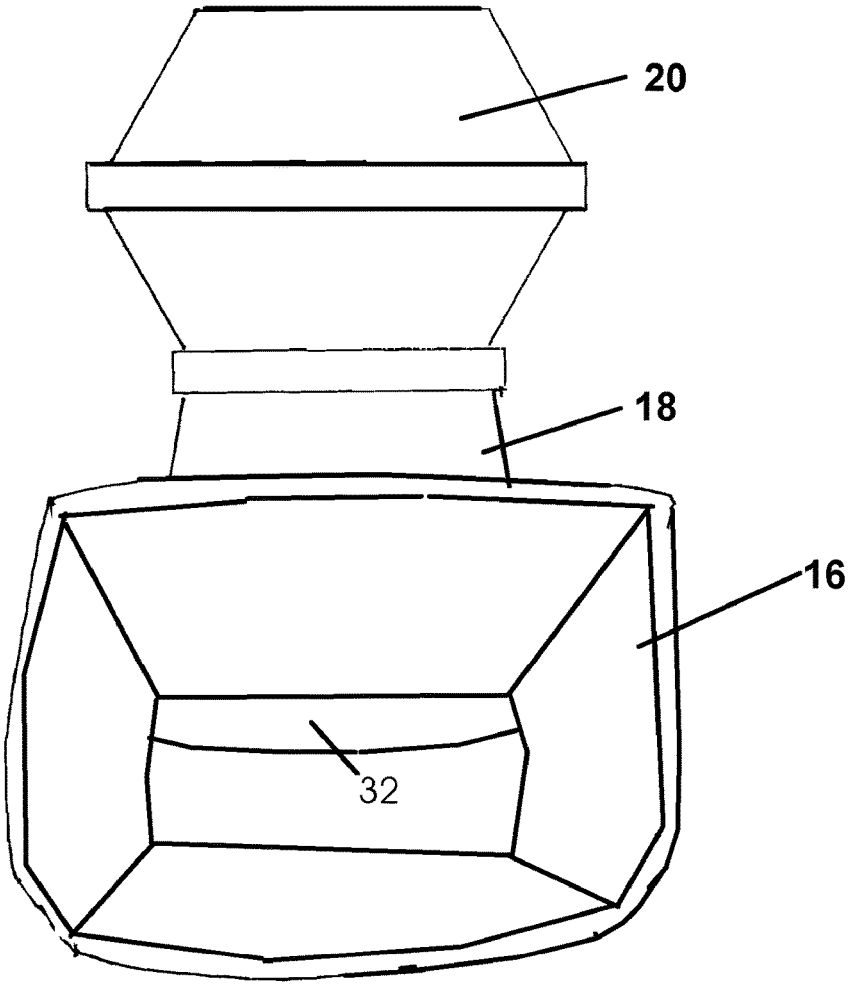
FIG. 4 is a front elevation of the loudspeaker system horn clear of its enclosure.

The size of the parabolic reflector section 32 is small enough that its presence is substantially invisible at sound frequencies below 300 Hz. Similarly small reflectors could be mounted inside horn 18 for focusing and reflection of a sound beam through the horn. In this context "small" would mean having smaller overall dimensions than a fraction of the wavelength of 300 Hz. sound. At higher frequencies the horn loses its impedance matching characteristics after the sound is focused into a beam. As can be seen in FIG. 2 parabolic reflector section 32 is in the first half of channel 21, being closer to the transducer 20 than to mouth 16.

Figure 5:
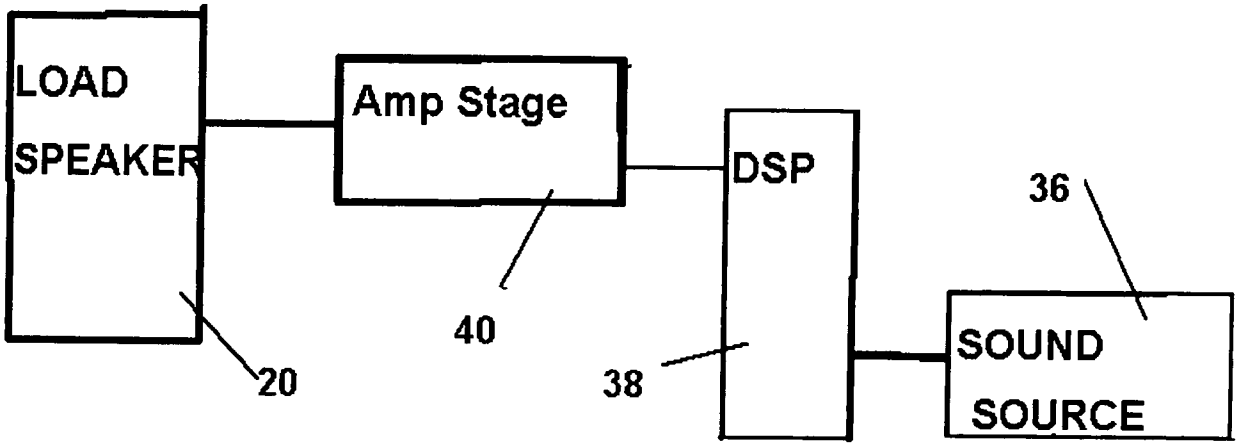
FIG. 5 is a block diagram of driving circuitry for the system acoustic transducer.
Figure 6A:
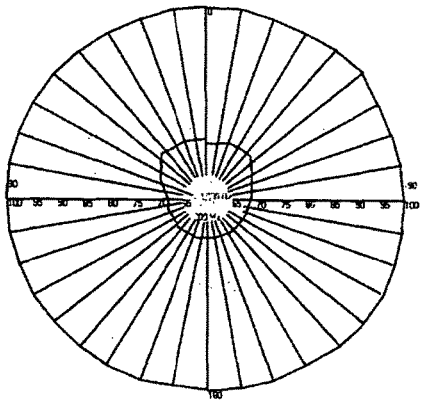
FIGS. 6A and B are polar diagrams of the frequency response of the detailed description.
Figure 6A:
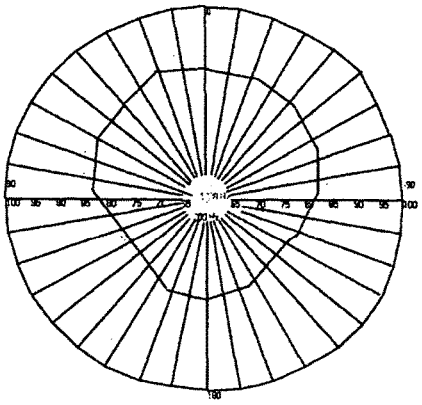
Figure 6B:
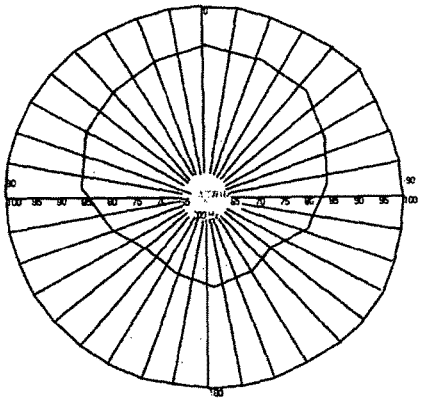
Figure 6B:
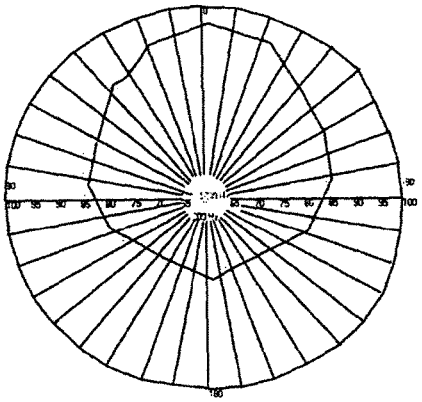

FIG. 5 particularly illustrates a block diagram circuit for excitation of the acoustic transducer/loudspeaker 20. Elements include a sound signal source 36 connected to a digital signal processor (DSP) 38 and an amplifier stage 40 connected to receive the output of the DSP 38. A digital signal processor 38 may be provided to adjust the relative amplitudes of frequency bands of the acoustic signal to accommodate the through put of a given horn after empirical evaluation of its throughput characteristics. The amplifier stage 40 drives the acoustic transducer 20. It is possible that distortion may occur over a narrow frequency band may be present where the parabolic reflector section 32 is partly effective and that the distortion may be reduced by reducing the amplitude of that bandwidth.

Figure 7:
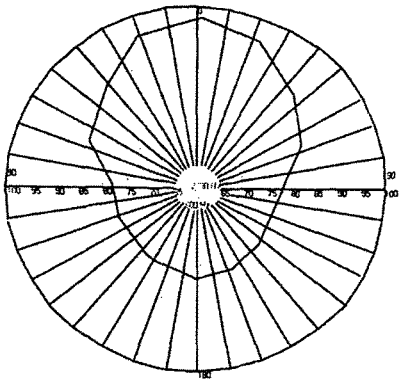
FIG. 7 are polar diagrams of the frequency response of the detailed description.
Figure 7:
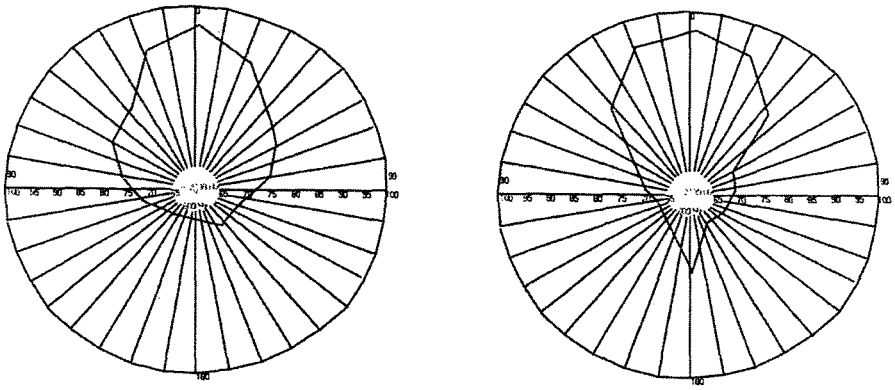

The loudspeaker system described here allows use of a single transducer to produce a wide band width of sound, without foregoing use of a folded horn in terms of compactness. The polar diagrams of FIGS. 6 and 7 illustrate throughput of sound through the folded horn at higher frequency ranges of human hearing.

The foregoing detailed description is not intended as limiting, but to be susceptible to various changes and modifications without departing from the spirit and scope of what is claimed.

What is claimed is:

1. A blended folded horn and reflector comprising:

a tube open at first and second ends and expanding with a constant flare rate from the first end to the second end;

the tube being folded from substantially adjacent the first end to substantially adjacent the second end over an angle sufficient to obstruct direct propagation of sound giving a frequency above a threshold frequency through the tube; and a reflector located within the fold including a sound focusing element exposed to the both the first and second ends for reflecting sound at frequencies above the threshold frequency introduced to the first end in a beam through the second end, the sound focusing element being positioned in a first half of the tube.

2. The blended folded horn and reflector as set forth in claim 1, further comprising:

an enclosure housing the tube.

3. The blended folded horn and reflector as set forth in claim 2, further comprising:

a sealed resonant chamber at the first end defined by the enclosure; and a transducer mounted in the sealed resonant chamber and oriented to radiate into the first end and without obstruction at the reflector.

4. The blended horn and reflector as set forth in claim 3, further comprising:

the reflector including a parabolic reflector region located on the interior surface toward an outside of the fold.

* * * * *